US008112929B2

(12) United States Patent
Eith et al.

(10) Patent No.: US 8,112,929 B2
(45) Date of Patent: Feb. 14, 2012

(54) KEY DEVICE FOR GUNS

(75) Inventors: Stefan Eith, Neu-Ulm (DE); Karl-Heinz Luther, Ense-Niederense (DE); Peter Dallhammer, Karlsruhe (DE); Wulf-Heinz Pflaumer, Arnsberg (DE); Franz Wonisch, Arnsberg (DE)

(73) Assignee: Carl Walther GmbH, Ulm (DE)

( * ) Notice: Subject to any disclaimer, the term of this patent is extended or adjusted under 35 U.S.C. 154(b) by 685 days.

(21) Appl. No.: 12/223,546

(22) PCT Filed: Feb. 4, 2006

(86) PCT No.: PCT/DE2006/000170

§ 371 (c)(1),
(2), (4) Date: Aug. 1, 2008

(87) PCT Pub. No.: WO2007/087764

PCT Pub. Date: Aug. 9, 2007

(65) Prior Publication Data

US 2009/0133307 A1 May 28, 2009

(51) Int. Cl.
*F41A 17/02* (2006.01)

(52) U.S. Cl. ..... 42/70.08

(58) Field of Classification Search ..... 42/70.08, 42/70.04, 70.05, 70.01, 70.11, 66
See application file for complete search history.

(56) References Cited

U.S. PATENT DOCUMENTS

| | | | | |
|---|---|---|---|---|
| 879,018 | A * | 2/1908 | Stone | 42/66 |
| 4,967,502 | A | 11/1990 | Vernon | |
| 5,946,840 | A | 9/1999 | Mickel | |
| 6,345,461 | B1 * | 2/2002 | Constant et al. | 42/84 |
| 6,434,875 | B1 * | 8/2002 | Constant et al. | 42/84 |
| 6,941,692 | B1 * | 9/2005 | Krinke et al. | 42/70.08 |
| 7,051,468 | B2 | 5/2006 | Glock | |
| 7,155,855 | B2 * | 1/2007 | Mauch et al. | 42/70.01 |
| 7,562,480 | B2 * | 7/2009 | Mauch et al. | 42/70.01 |
| 7,757,420 | B1 * | 7/2010 | Corsaro et al. | 42/70.01 |
| 2003/0145504 | A1 * | 8/2003 | Durossette | 42/70.04 |
| 2004/0111945 | A1 * | 6/2004 | Glock | 42/70.08 |
| 2005/0229460 | A1 * | 10/2005 | LaFleur | 42/69.03 |
| 2007/0119087 | A1 * | 5/2007 | Corsaro et al. | 42/70.01 |

FOREIGN PATENT DOCUMENTS

EP 1 443 295 8/2004

OTHER PUBLICATIONS

International Search Report.

* cited by examiner

*Primary Examiner* — Bret Hayes
*Assistant Examiner* — Reginald Tillman, Jr.
(74) *Attorney, Agent, or Firm* — Collard & Roe, P.C.

(57) ABSTRACT

In a key element (110) for locking a hammer gun or bolt gun (100) comprising a trigger rod which can be reciprocated by a trigger, the locked state of the gun is apparent at a glance in a conspicuous manner in that the key element (110) is a releasably securely attachable component of the gun housing.

15 Claims, 6 Drawing Sheets

KEY DEVICE FOR GUNS

CROSS REFERENCE TO RELATED APPLICATIONS

This application is the National Stage of PCT/DE2006/000170 filed on Feb. 4, 2006, which claims priority under 35 U.S.C. §119 of PCT/DE2006/000170 filed on Feb. 4, 2006. The international application under PCT article 21(2) was not published in English.

The invention relates to a key device having a key element for locking a hammer gun or bolt gun comprising a trigger rod which can be reciprocated by a trigger.

Key devices of the above type are used in the prior art to prevent use by unauthorized persons. However, the known devices suffer from the drawrear that it is not possible to indicate in a conspicuous manner that the gun is blocked or in an unusable locked state.

It is thus an object of the invention to provide a key device by means of which the locked state of the gun is apparent at a glance in a conspicuous manner.

For a device of the above type, this object is achieved in that the key element is a releasably securely attachable part of the gun housing.

In particular, this object is achieved in that the key element is formed as a rear portion of the grip of the gun.

Preferred embodiments of the invention are the subject matter of the subordinate claims.

In the device of the invention, the feature to the effect that the key element is a releasably securely attachable part of the gun housing has the effect that an unusable state of the gun is directly visible to any person due to the fact that a "locked" gun has an incomplete gun housing and is therefore evidently not usable.

In particular and preferably, the present invention provides for the key element to be formed as a rear portion of the grip of the gun.

According to a first important preferred embodiment of the device of the invention, provision is made for the key element to be coupled with a movably mounted gate element having a shift gate to guide the trigger rod, and when the key element has been inserted into the gun, the gate element is disposed in a first position, in which the shift gate of the movably mounted gate element is oriented so as to allow for interaction between the trigger rod and the bolt for the purpose of cocking and releasing the bolt.

According to another important preferred embodiment of the device of the invention, provision is made for the gate element to be biased by a key spring such that when the key element is removed from the gun the gate element assumes a biased second position, in which the trigger rod is oriented so as to prevent interaction between the trigger rod and the bolt and, if necessary, to decock a cocked bolt.

According to another important preferred embodiment of the device of the invention, provision is made for the gate element to assume a third position, when the key element is absent from the gun, by the action of the key spring, in which position both interaction between the trigger rod and the bolt and interaction between a bolt stop and the bolt are prevented so that a breech block in which the bolt is present can be totally removed from the gun.

The gate element is preferably coupled at its end region with a push stick, which is at least indirectly connected to the key element. The coupling of the push stick with the gate element is preferably effected with the aid of a protrusion on the push stick adapted to engage a recess formed in the region of the end the gate element.

Furthermore, the bolt stop is preferably formed in the region of the end of the push stick, and the push stick is preferably connected in the region of its other end to a slide bar coupled with the key element.

The mobility of the gate element is preferably realized in that the gate element is rotatable about a fulcrum in the region of its other end. The gate element preferably comprises a shift gate, in which a sliding gate member connected to the trigger rod is mounted for reciprocation. The shift gate is preferably of a substantially linearly straight design.

Interaction between the trigger rod and the bolt is preferably effected in that a trigger rod mandril connected to the trigger rod bears against a projection of a bolt entrainer connected to the bolt and interaction between the bolt stop and the bolt is preferably effected in that the bolt stop bears against a bolt entrainer connected to the bolt.

According to another important preferred embodiment of the device of the invention, provision is made for the key element to contain a locking element which is biased toward a locking block, and the key element, when inserted, is braced against an arresting block on the grip. The key element preferably has a mandrel adapted to be releasably inserted into a recess of the push stick.

Furthermore, the key element is preferably formed such that when the locking element is released from the locking block by means of manual force acting on the locking element, the key element connected via the mandrel to the slide bar is moved by the action of the key spring biasing the slide bar in the expanding direction of the key spring until a stop limit surface of the key element abuts a stop block anchored in the grip. The key element can then be removed from the grip after the stop limit surface has abutted the stop block.

The device of the invention is explained below with reference to a preferred embodiment illustrated in the figures of the drawings, in which.

Figure 1:
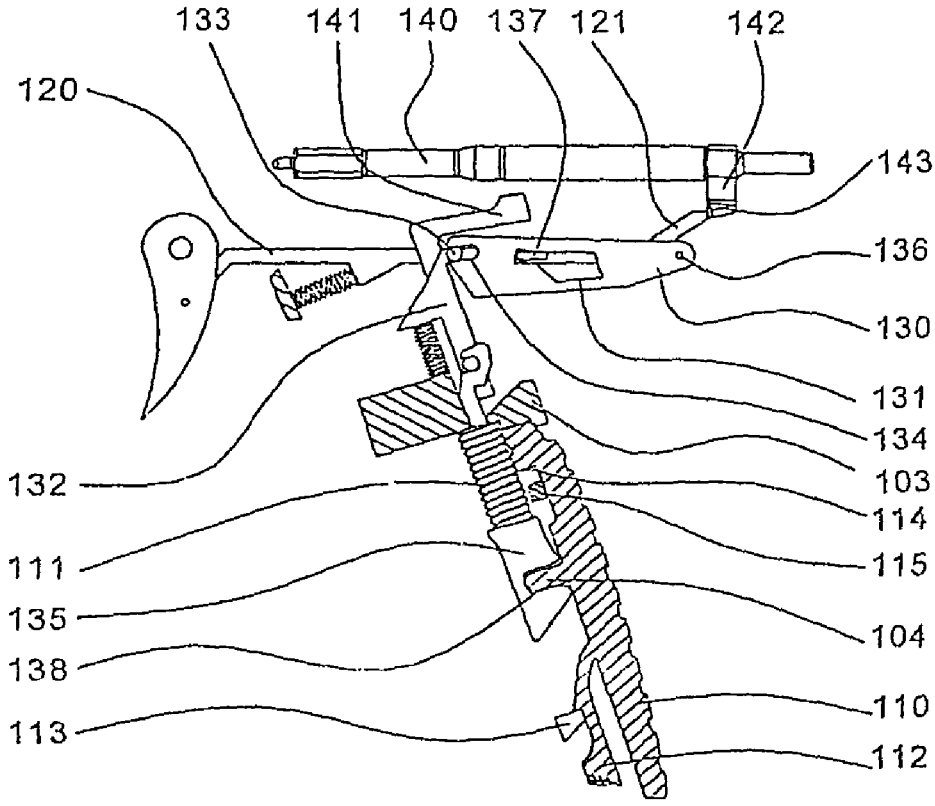
FIG. 1 is a diagrammatic side view of a first preferred embodiment of the device of the invention with the rear portion of the grip securely fixed and the gun cocked.
Figure 2:
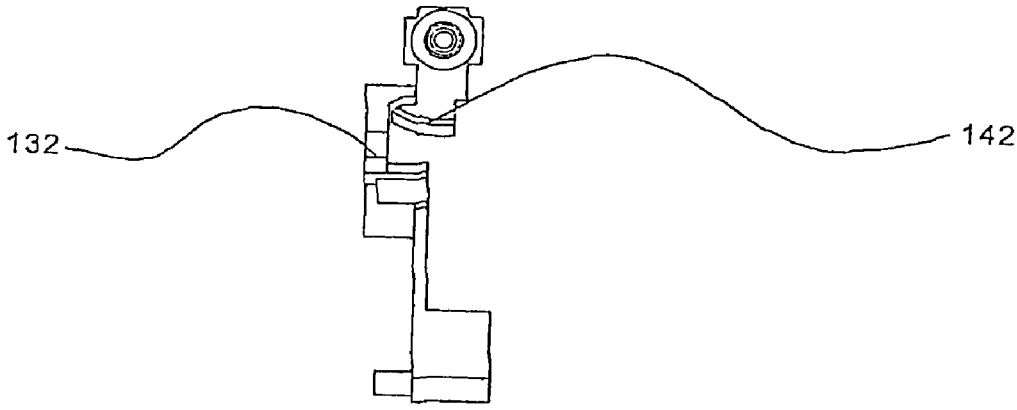
FIG. 2 is a rear view of the preferred embodiment of the device of the invention shown in FIG. 1.
Figure 3:
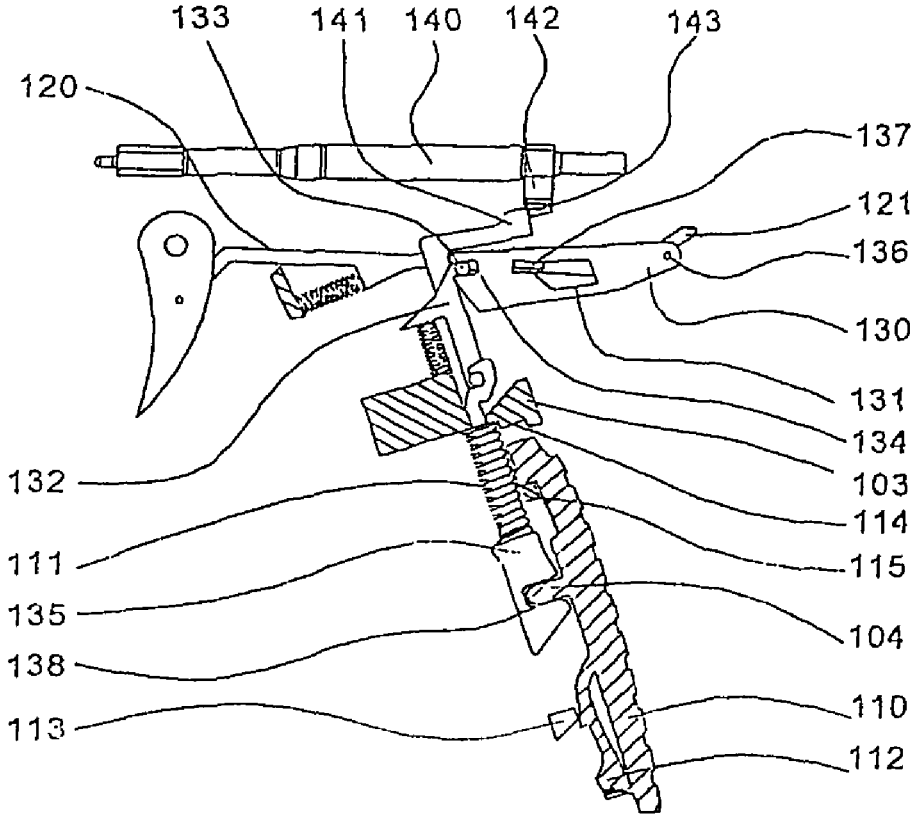
FIG. 3 is a diagrammatic side view of the preferred embodiment of the device of the invention shown in FIG. 1 with the rear portion of the grip removed and the gun decocked.
Figure 4:
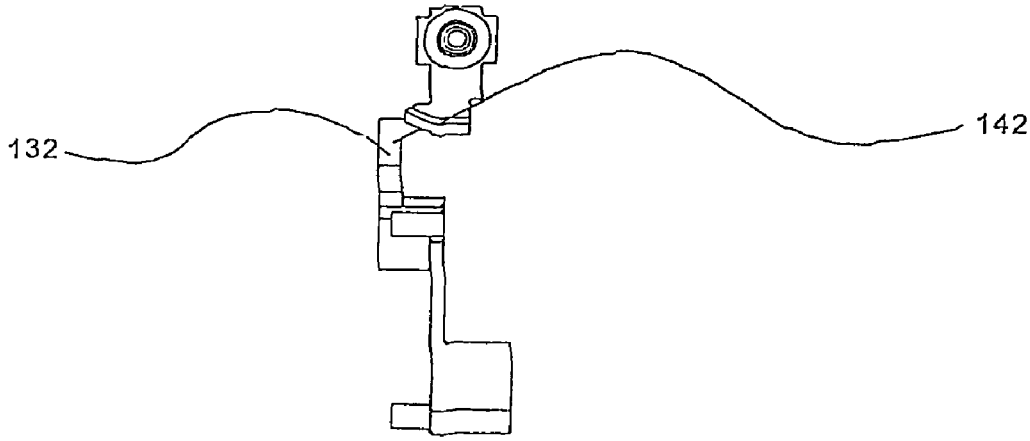
FIG. 4 is a rear view of the preferred embodiment of the device of the invention shown in FIG. 3.
Figure 5:
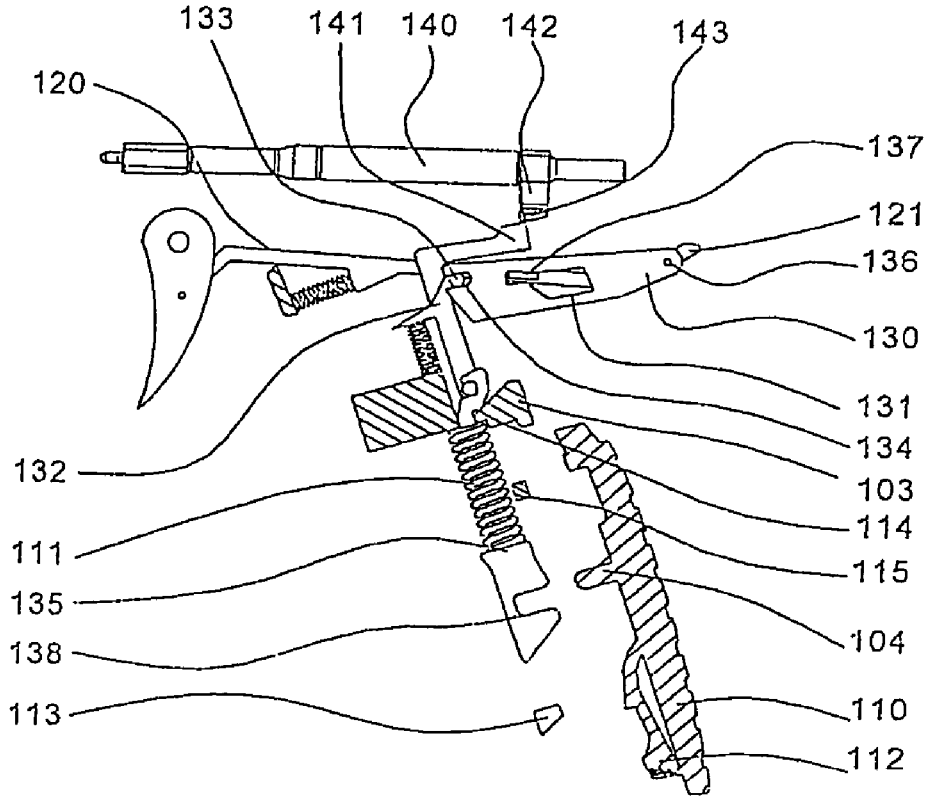
FIG. 5 is a diagrammatic side view of the preferred embodiment of the device of the invention shown in FIG. 1 with the rear portion of the grip removed and the gun decocked.
Figure 6:
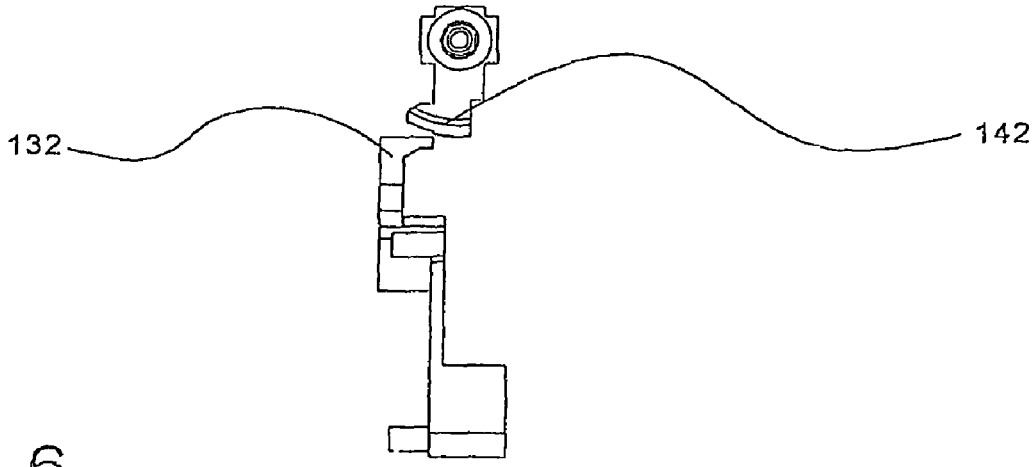
FIG. 6 is a rear view of the preferred embodiment of the device of the invention shown in FIG. 5.

In the locking device 110, 132, 135, 130 of the invention illustrated in FIGS. 1 to 6, the key element 110 is coupled with a movably mounted gate element 130 having a shift gate 131 for guiding the trigger rod 120, and when the key element 110 is inserted in the gun 100, the gate element 130 is in a first position, in which the shift gate 131 of the movably mounted gate element 130 is oriented so as to enable interaction between the trigger rod 120 and the bolt 140 for the purpose of cocking and releasing the bolt 140. The gate element 130 is biased by a key spring 111 such that when the key element 110 is removed from the gun the gate element 130 is in a biased second position in which the trigger rod 120 is oriented so as to prevent interaction between the trigger rod 120 and the bolt 140 and, if necessary, to decock a cocked bolt 140.

Following removal, when the key element 110 is absent from the gun 100, the gate element 130 is in a third position due to the action of the key spring 111, in which position both interaction between the trigger rod 120 and the bolt 140 and interaction between a bolt stop 141 with the bolt 140 are prevented such that a breech block 150 containing the bolt 140 can be totally removed from the gun 100.

The gate element 130 is coupled, in the region of one end thereof, with a push stick 132, which is at least indirectly connected to the key element 110. Coupling of the push stick 132 with the gate element 130 is effected with the aid of a protrusion 133 on the push stick, which protrusion engages a recess 134 formed in the region of one end of the gate element 130.

The bolt stop 141 is formed in the region of one end of the push stick 132, and the pusher stick 132 is connected at its other end to a slide bar 135 coupled with the key element 110. The gate element 130 is at its other end rotatable about a fulcrum 136 and comprises the shift gate 131, in which a sliding member connected to the trigger rod 120 is mounted for reciprocation. The shift gate 131 is substantially of linearly straight design.

Interaction between the trigger rod 120 and the bolt 140 is effected in that a trigger rod mandril 120 connected to the trigger rod 121 bears against a projection 143 of a bolt entrainer 142 connected to the bolt 140. Furthermore, interaction between the bolt stop 141 and the bolt 140 is effected in that the bolt stop 141 bears against a bolt entrainer 142 that is connected to the bolt 140.

The key element 110 comprises a locking element 112, which is biased toward a locking block 113, and the key element 110, when inserted, is braced against an arresting block 103 of the grip (102). Furthermore, the key element 110 is provided with a mandrel 104, which can be releasably inserted into a recess 138 in the slide bar 135. When the locking element 112 is released from the locking block 113 by means of manual force exerted on the locking element 112, the key element 110 connected to the slide bar 135 via the mandrel 104 can be moved by the action of the key spring 111 urging the slide bar 135 in the expanding direction of the key spring 111 until a stop limit surface 114 of the key element 110 hits a stop block 115 anchored in the grip (102).

Once the stop limit surface 114 has hit the stop block 115, the key element 110 can be removed from the grip (102).

The above exemplary embodiment of the invention serves only the purpose of providing better comprehension of the teaching of the invention defined in the claims, which teaching is not, as such, limited to the exemplary embodiment.

The invention claimed is:

1. A key device having a key element for locking a hammer gun or bolt gun comprising a trigger rod which can be reciprocated by a trigger, said key element being a releasably securely attachable component of the gun housing, wherein the key element is in the form of a rear portion of the grip of the gun;

wherein the key element is coupled with a movably mounted gate element having a shift gate for guiding the trigger rod, and when the key element is inserted in the gun, the gate element is in a first position, in which the shift gate of the movably mounted gate element is oriented so as to enable interaction between the trigger rod and the bolt for the purpose of cocking and releasing the bolt; and wherein the gate element is biased by a key spring such that when the key element is removed from the gun the gate element is in a biased second position in which the trigger rod is oriented so as to prevent interaction between the trigger rod and the bolt and, if necessary, to decock a cocked bolt.

2. The device as defined in claim 1, wherein when the key element is absent from the gun, the gate element is in a third position due to the action of the key spring, in which position both interaction between the trigger rod and the bolt and interaction between a bolt stop and the bolt are prevented such that a breech block containing the bolt can be totally removed from the gun.

3. The device as defined in claim 2, wherein the gate element is coupled, in the region of a first end of the gate element, with a push stick, which is at least indirectly connected to the key element.

4. The device as defined in claim 3, wherein coupling of the push stick with the gate element is effected with the aid of a protrusion on the push stick, which protrusion engages a recess formed in the region of the end of the gate element.

5. The device as defined in claim 3, wherein the bolt stop is formed in the region of one end of the push stick.

6. The device as defined in claim 3, wherein the push stick is connected at its other end to a slide bar coupled with the key element.

7. The device as defined in claim 3, wherein the gate element is at a second end rotatable about a fulcrum.

8. The device as defined in claim 1, wherein interaction between the trigger rod and the bolt is effected in that a trigger rod mandril connected to the trigger rod bears against a projection of a bolt entrainer connected to the bolt.

9. The device as defined in claim 2, wherein interaction between the bolt stop and the bolt is effected in that the bolt stop bears against a bolt entrainer that is connected to the bolt.

10. The device as defined in claim 6, wherein the key element comprises a locking element, which is biased toward a locking block, and the key element, when inserted, is braced against an arresting block of the grip.

11. The device as defined in claim 10, wherein the key element is provided with a mandrel, which can be releasably inserted into a recess in the slide bar.

12. The device as defined in claim 11, wherein when the locking element is released from the locking block by means of manual force exerted on the locking element, the key element connected to the slide bar via the mandrel can be moved by the action of the key spring urging the slide bar in the expanding direction of the key spring until a stop limit surface of the key element hits a stop block anchored in the grip.

13. The device as defined in claim 12, wherein when the stop limit surface has hit the stop block, the key element can be removed from the grip.

14. A key device having a key element for locking a hammer gun or bolt gun comprising a trigger rod which can be reciprocated by a trigger, said key element being a releasably securely attachable component of the gun housing, wherein the key element is in the form of a rear portion of the grip of the gun;

wherein the key element is coupled with a movably mounted gate element having a shift gate for guiding the trigger rod, and when the key element is inserted in the gun, the gate element is in a first position, in which the shift gate of the movably mounted gate element is oriented so as to enable interaction between the trigger rod and the bolt for the purpose of cocking and releasing the bolt; and wherein in the shift gate of the gate element a sliding member connected to the trigger rod is mounted for reciprocation.

15. The device as defined in claim 14, wherein the shift gate is substantially of linearly straight design.

* * * * *